United States Patent [19]

Pizzoccaro

[11] 4,160,306

[45] Jul. 10, 1979

[54] METHOD AND AN APPARATUS FOR INDICATING LENGTH ON A ZIP FASTENER

[75] Inventor: Luigi Pizzoccaro, Tirano, Italy

[73] Assignee: Interbrev S.A., Luxembourg, Luxembourg

[21] Appl. No.: 779,517

[22] Filed: Mar. 21, 1977

[30] Foreign Application Priority Data

Mar. 20, 1976 [CH] Switzerland ..... 3457/76

[51] Int. Cl.[2] ..... A44B 19/24

[52] U.S. Cl. ..... 24/205 R; 24/205.16 R

[58] Field of Search ..... 24/205.16 R, 205.11 F, 24/205 R

[56] References Cited

U.S. PATENT DOCUMENTS

D. 97,035 10/1935 Blatz ..... 24/205.16 R 3,951,715 4/1976 Hofius ..... 24/205.11 F

FOREIGN PATENT DOCUMENTS 583777 12/1946 United Kingdom ..... 24/205.16 R

*Primary Examiner*—Kenneth J. Dorner

*Attorney, Agent, or Firm*—Miller & Prestia

[57] ABSTRACT

A method and an apparatus for indicating length on a zip fastener comprising plastics or metal coupling elements obtained by molding on support strips. A numeral or symbol indicating length is obtained by molding on at least one of the support strips during the molding of the coupling elements. The apparatus comprises a mold for molding coupling elements, said mold includes at least one impression for molding a numeral or symbol.

5 Claims, 3 Drawing Figures

METHOD AND AN APPARATUS FOR INDICATING LENGTH ON A ZIP FASTENER

Figure 1:
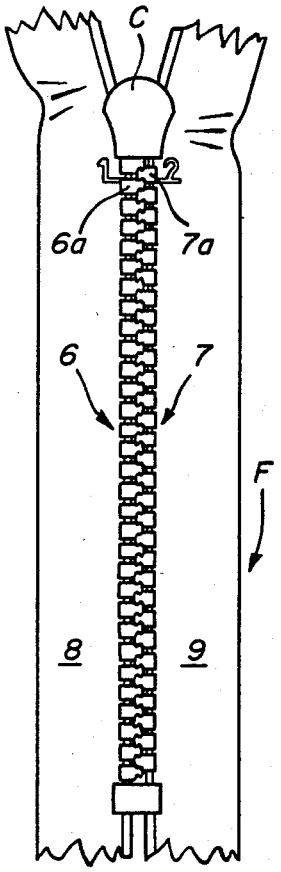

This invention relates to zip fasteners, Zip fasteners comprise two support strips each bearing a row of coupling elements along an edge thereof, and a slider by means of which the coupling elements of the two support strips may be interlocked with each other or disengaged from each other. It is desirable to have, marked upon a zip fastener, an indication of the length thereof. The length indicating means are generally applied on one of the two support strips by stamping or labelling, i.e. by an independent operation which is generally manual, since automation thereof would result in very complicated, expensive devices and consequently substantially increase the cost of the fasteners.

The method of indicating length by stamping or labelling has numerous disadvantages. For example, in the case of stamping, inks of various colors may be constantly available and the inking device must be changed whenever the stamping color is changed. In the case of labelling, it is necessary to store various labels. Both stamping and labelling are manual operations and therefore slow and liable to human error, resulting in wastage.

The invention relates to a method of indicating length on a zip fastener utilizing thermoplastics or metal coupling elements obtained by molding, so as to obviate the aforementioned disadvantages of the prior-art methods, and also relates to an apparatus for carrying out the method.

According to one aspect of the invention there is provided a method of indicating length on a zip fastener comprising plastic or metal coupling elements obtained by molding, characterised in that at least one numeral or symbol, i.e. a character, indicating length is obtained by molding on at least one of the support strips during the molding of the coupling elements.

The molded metal or thermoplastic coupling elements are preferably molded by means of a molding machine operating at an elevated pressure, the two support strips, each adapted to receive a row of coupling elements at its edge, being placed in a mold, after which molten thermoplastic or molten metal is injected at high pressure into the mold and left to cool. The mold may be adapted to mold either fasteners having a single length or fasteners having a number of lengths.

According to another aspect of the invention there is provided apparatus for performing the method of the invention comprising a mold for molding coupling elements on support strips to form a zip fastener, said mold including at least one impression for molding a numeral or symbol to indicate the length of the zip fastener.

Each numeral or symbol indicating the length of the zip fastener can be molded either (a) on one of the two support strips adjacent or at a distance from the row of coupling elements or (b) partly on one support strip and partly on the other (i.e. in the normal case where the number indicative of length is a two digit number, one digit may be molded on one strip and the other digit on the other.

Figure 2:
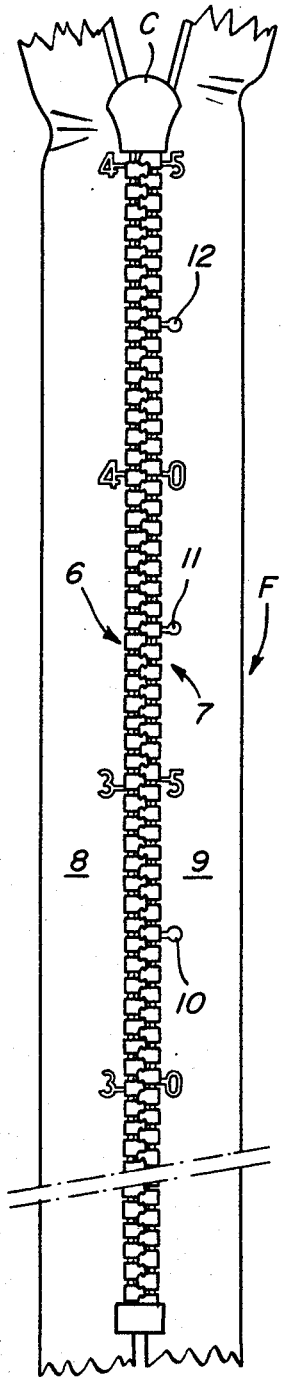
Figure 3:
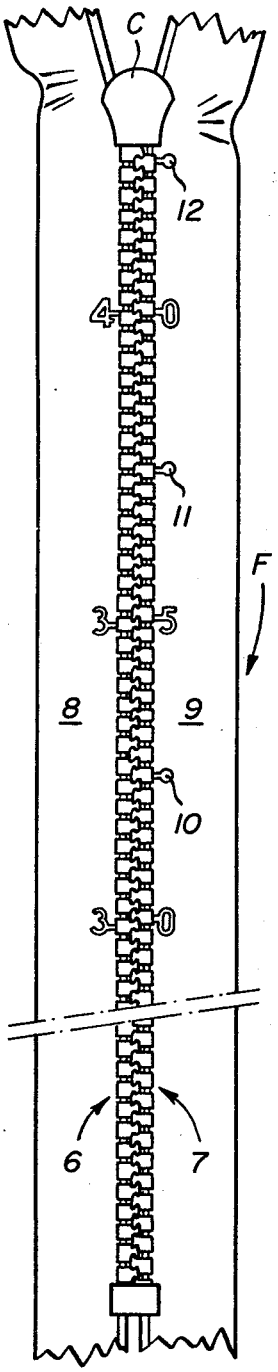

Embodiments of the invention are described below with reference to the accompanying drawings, in which:

FIG. 1 shows a zip fastener obtained, using a method in accordance with the invention, from a mould adapted for a single length of 12 cm, and FIGS. 2 and 3 show 45 cm and 42.5 cm long zip fasteners respectively, obtained, using a method in accordance with the invention, from a mold adapted for lengths between 30 and 45 cm.

FIG. 1 shows a 12 cm fastener, the length of which is indicated by the number 12, shown at the top end of the fastener near a slider C. The two digits 1 and 2 forming the number 12 are obtained by molding, at the same time as the two rows of coupling elements 6 and 7 respectively, each molded at the edge of a support strip 8 and 9 respectively. Digits 1 and 2 are each molded on one strip, the digit 1 on support strip 8 and the digit 2 on strip 9, so that when the fastener is in the closed position (shown in the drawing) the two digits are disposed symmetrically with respect to the rows of coupled coupling elements 6, 7 and thus form the number 12 indicating the length of the fastening.

To obtain the number 12, it is sufficient to provide impressions of the digits 1 and 2, one on each of the two halves of the mold for molding the two rows of coupling elements, and to connect each impression, via a small channel, to the impression of a coupling element. As shown in FIG. 1, the impression of digit 1 is connected to the impression of element *6a* and the impression of digit 2 is connected to the impression of element *7a*. When it is desired to mold both digits forming a number on one of the tapes, the corresponding impressions will be made on the same half of the mold and connected to the impression of at least one coupling element belonging to the row to be molded by the same half of the mold.

Thus, to obtain a length-indicating means by the method according to the invention, it is sufficient to provide impressions of the desired number or sign on the mold for molding the coupling elements and to connect them, via a small channel, to the impression of at least one coupling element.

FIG. 2 shows a 45-cm fastener in which the coupling elements and the number 45 which indicates its length, are molded in a mold adapted to mold fasteners of various lengths, i.e. 30, 32.5, 35, 37.5 40, 42.5 and 45-cm fasteners in the present case. In order to mold each number, the mold must comprise the corresponding impressions. In the present case, the mold bears the impressions of numbers 30, 35, 40 and 45 and a small circle 10, 11 and 12 respectively between each such impression, indicating intermediate lengths, in the case illustrated lengths midway between those indicated by adjacent impressions of numerals. Thus not only is the number indicating the length of the fastener displayed but also the lower numbers which serve to indicate the lengths of shorter fasteners molded in the same mold. All of these numbers are molded on the fastener and are visible on the back thereof. Consequently, the length of the fastener corresponds to the largest number which it bears.

FIG. 3 shows a 42.5 cm fastener, i.e. having a length corresponding to the largest numeral (40) which it bears, plus a number, 2.5, corresponding to half of the difference between adjacent numerals, in accordance with the small circle 12 above the numeral 40.

As the preceding description shows, the method according to the invention can obviate the independent operation of indicating the length of a zip fastener by stamping or labelling, and consequently eliminates all the disadvantages of such an operation.

I claim:

1. A zipper fastener comprising:

a set of support strips;

a row of coupling elements molded on an edge of each support strip, said coupling elements adapted to engage the coupling elements of the other support strip;

a slider for engaging and disengaging of said rows of coupling elements; and a plurality of molded characters extended along the length of at least one of said support strips, each of said characters constructed to indicate the length of said fastener at the approximate position of said character along said support strip, each of said characters being in contact with at least one of said coupling elements and spaced from the edge of said support strip.

2. A zipper fastener in accordance with claim 1, wherein said character is a symbol.

3. A zipper fastener in accordance with claim 1, wherein said character is a numeral.

4. The zipper fastener in accordance with claim 3, wherein a character is on each of said support strips.

5. A zipper fastener comprising:

a set of support strips;

a row of coupling elements molded on an edge of each support strip, said coupling elements adapted to engage the coupling elements of the other support strip;

a slider for engaging and disengaging said rows of coupling elements; and a character molded on at least one of the support strips, said character constructed to indicate the length of said fastener at the approximate position of said character along said support strip, said character being spaced from said coupling elements and has an arm extending therefrom and in communication with at least one of said coupling elements.

* * * * *